United States Patent [19]

Popp

[11] 4,320,786

[45] Mar. 23, 1982

[54] MEASURING DEVICE FOR THREAD AND A METHOD OF ADJUSTING THE LENGTH OF A TRAVELLING THREAD

[75] Inventor: Karl Popp, Ruti, Switzerland

[73] Assignee: Sulzer Brothers Limited, Winterthur, Switzerland

[21] Appl. No.: 124,714

[22] Filed: Feb. 26, 1980

[30] Foreign Application Priority Data

Mar. 1, 1979 [CH] Switzerland ..... 2033/79

[51] Int. Cl.[3] ..... D03D 47/34

[52] U.S. Cl. ..... 139/452; 66/132 R

[58] Field of Search ..... 139/452; 66/132; 226/139, 151

[56] References Cited

U.S. PATENT DOCUMENTS 2,189,492 2/1940 Henne ..... 66/132
3,194,276 7/1965 Krukonis et al. ..... 139/452
3,853,153 12/1974 Duynhoven et al. ..... 139/452
3,918,275 11/1975 Paepke ..... 66/132

FOREIGN PATENT DOCUMENTS 1585427 1/1971 Fed. Rep. of Germany .
WO 80/00577 4/1980 Pct Int'l Appl. ..... 139/452

*Primary Examiner*—Henry Jaudon
*Attorney, Agent, or Firm*—Kenyon & Kenyon

[57] ABSTRACT

The measuring device is used for measuring lengths of thread, for example for measuring weft thread for a weaving machine. The measuring device includes a constantly rotating winding body or drum and a thread guide which is adjustable longitudinally of the drum. The thread guide is spaced from the drum and has one or more guide surfaces formed by eyelets or a comb. By shifting the thread guide axially of the drum, the length of thread in the windings on the drum can be increased or decreased per unit time during operation.

8 Claims, 4 Drawing Figures

MEASURING DEVICE FOR THREAD AND A METHOD OF ADJUSTING THE LENGTH OF A TRAVELLING THREAD

This invention relates to a measuring device for thread and to a method of adjusting the length of the travelling thread. More particularly, this invention relates to a measuring device for thread fed to a weaving machine.

Heretofore, it has been known to provide various types of devices and techniques for the measurement or length adjustment of filamentary material such as threads which are to be supplied to a processing station such as a weaving machine. For example, it has been known from German A.S. No. 21 17 705 to pass a thread which is to be measured from a supply bobbin through an eyelet onto a cylinder on which the thread forms several turns for subsequent supply to the processing station. As described, the individual turns of the thread are guided through juxtaposed eyelets of an eyelet support disposed next to the cylinder in spaced relation. In order to adjust the thread length running over the cylinder per unit time, the speed of rotation of the clinder is varied. However, the adjustment of a thread length is relatively difficult and imprecise in such a device.

Accordingly, it is an object of the invention to provide a measuring device for accurately measuring lengths of thread.

It is another object of the invention to provide a relatively simple means of measuring a length of travelling thread.

It is another object of the invention to be able to supply accurate lengths of thread from a continuous supply of thread.

Briefly, the invention provides a measuring device for thread which is comprised of a conical winding body, a thread guide and means for adjusting the thread guide longitudinally relative to the winding body. The conical winding body is mounted about a longitudinal axis of rotation and has an outer circumferential surface for receiving a plurality of thread windings thereon. The thread guide has a plurality of guide surfaces disposed in spaced relation to and along a plane oblique to the circumferential surface of the body with each guide surface being disposed to receive a respective thread winding thereon. The means for adjusting the thread guide moves the guide along the oblique plane and serves to adjust the length of a thread on the circumferential surface of the winding body during rotation.

The direction of inclination of the oblique plane in which the guide surfaces are aligned relative to the surface of the winding body is such that the single turns of the thread have essentially the same length. Thus, a displacement of the thread turns along the winding body and, thus, a change of thread length is possible at constant yarn tension.

In one embodiment, the thread guide is in the form of a comb having a plurality of teeth with each guide surface disposed between an adjacent pair of teeth. Further, the plane along which the guide surfaces are aligned may also be at a slope opposite to the slope of the circumferential surface of the body.

In still another embodiment, the thread guide may be of one piece construction with a plurality of eyelets therein to form the guide surfaces.

The means for adjusting the thread guide may also include a threaded spindle for adjusting the thread guide upon rotation of the spindle.

The conical winding body may also have a circumferential surface which is stepped in order to define a plurality of cylindrical sections with interconnecting conical surfaces therebetween.

The invention also provides a method of adjusting the length of a travelling thread fed to a processing station. In accordance with the invention, the method is comprised of the steps of passing the travelling thread over a rotating conical winding body having an outer circumferential surface in order to form a plurality of thread windings thereon, of guiding each one of a plurality of the windings over a respective guide surface of a plurality of guide surfaces spaced from the body along a plane oblique to the circumferential surface and of adjusting the guide surface relative to the winding body during rotation of the body at a constant speed in order to adjust the thread length travelling over the winding body per unit time. In this regard, the guide surface is adjusted along the oblique plane longitudinally of the winding drum surface.

In accordance with the invention, it becomes possible in a simple manner to adjust the thread length running over the drum per unit time without any variation in the speed of rotation of the winding drum. In this way, it is possible to adjust the thread length to the current need, for example, for the insertion of a weft thread into a weaving machine. To this end, the windings of the thread on the drum can be shifted into a drum region of greater or smaller circumference by means of the thread guide.

These and other objects and advantages of the invention will become more apparent from the following detailed description and appended claims taken in conjunction with the accompanying drawings in which:

Figure 1:
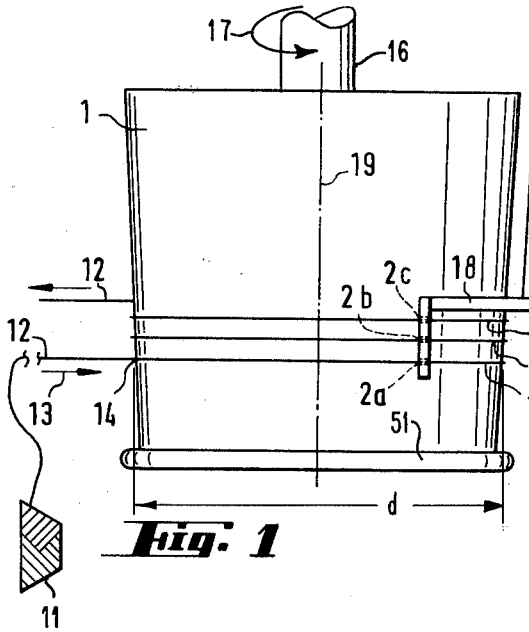
FIG. 1 illustrates a top view of a modified measuring device in accordance with the invention.
Figure 2:
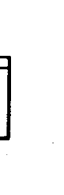
FIG. 2 illustrates a front view of a threaded guide used in the measuring device of FIG. 1.

Referring to FIGS. 1 and 2, the measuring device is utilized for feeding accurate lengths of thread to a processing station such as weaving machine. In this case, the measuring device is located between a weft thread supply bobbin 11 and a weft insertion device of a weaving machine.

As illustrated, the measuring device includes a conical winding body in the form of a drum 1, for example coated with rubber, which is mounted on a shaft 16 so as to rotate about a longitudinal axis of rotation 19 as indicated by the arrow 17 at a constant speed of rotation. The winding body or drum 1 has an outer circumferential surface which terminates at one end in a bead 51.

During operation, a thread 12 travelling from the weft thread supply bobbin 11 is passed in the direction indicated by the arrow 13 over the rotating conical winding drum 1 to form a plurality of thread windings thereon. As shown in FIG. 1, the winding drum has a winding diameter d at a feed point 14 located above the drum.

Referring to FIGS. 1 and 2 the thread guide may be made of a one piece body secured to a support 18. In this case, the thread guide has a plurality of eyelets 2*a*, 2*b*, 2*c*, to form the guide surfaces for the respective thread windings.

Figure 3:
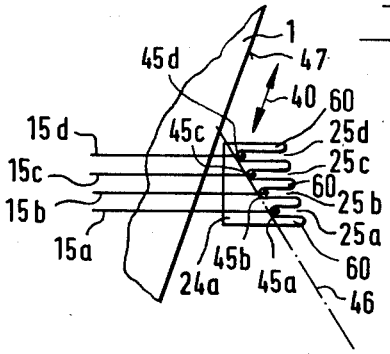
FIG. 3 illustrates a view of a further modified thread guide in accordance with the invention.

Referring to FIG. 3, wherein like reference characters indicate like parts as above, the thread guide may be in the form of a comb 24*a* having the guide surfaces 45*a*–45*d* for the thread windings 15*a*–15*d* aligned along a plane 46 oblique to the circumferential surface of the winding drum 1. In this way, the individual windings 15*a*–15*d* can be maintained approximately or exactly in length. Thus, when laying the windings, the thread need not be stretched and, conversely, cannot become slack. The slope of the oblique plane of the guide surfaces may also be opposite to the slope of the circumferential surface of the windings drum 1.

It is to be noted that the guide surfaces 45*a*–45*d* are located at the apices of the gaps 25*a*–25*d*.

Should the length of thread required for a pick become greater or less, the windings 15*a*, 15*e* are shifted into a corresponding region of the drum 1 having a larger or smaller diameter via an adjustment of the support 18 of the thread guide. The thread length running over the drum 1 thus becomes greater or smaller per unit time and can be adapted to the respective operation.

The bead 51 located at the end of the drum serves to protect againt the thread windings falling off the drum, particularly during the laying on of the windings.

By providing accurate lengths of measured thread lengths to a weaving machine, for example a weaving machine wherein a weft is picked by an air jet, unnecessarily long thread ends can be avoided on the side of the shed opposite the picking mechanism. This, in turn, eliminates the need to cut off the excessive thread lengths on this side of the shed. Hence, thread waste can be reduced to a minimum.

Figure 4:
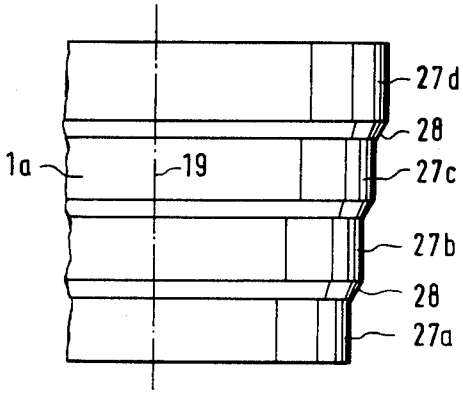
FIG. 4 illustrates a view of a modified winding body in accordance with the invention.

Referring to FIG. 4, the conical winding drum 1*a* may alternatively have a circumferential surface which is stepped in order to define a plurality of cylindrical sections 27*a*–27*d*. As shown, the diameter of these cylindrical sections 27*a*–27*d* increases in the upper direction in the sense of a total conicity of the drum 1*a*. In order to provide for an easier laying of the thread windings, interconnecting conical surfaces 28 may be provided between the cylindrical sections 27*a*–27*d*.

It is to be noted that the measuring device may be provided with a thread guide which does not act on all of the thread windings.

The invention thus provides a measuring device and method whereby the length of a travelling thread can be adjusted in an accurate simple manner to requirements through a simple adjustment of the thread guide. Thus, by simply shifting the thread guide longitudinally of the winding drum, the length of thread on the drum can be increased or decreased, manually or automatically.

What is claimed is:

1. A measuring device for thread, said device comprising a conical winding body mounted about a longitudinal axis of rotation and having an outer circumferential surface for receiving a plurality of thread windings thereon;

a thread guide having a plurality of guide surfaces disposed in spaced relation to said circumferential surface along a plane oblique to and at a slope opposite to the slope of said circumferential surface, each said guide surface being disposed to receive a respective thread winding therein; and means for adjusting said thread guide longitudinally along said plane relative to said winding body to adjust the length of a thread on said circumferential surface.

2. A measuring device as set forth in claim 1 wherein said thread guide is a comb having a plurality of teeth with each guide surface disposed between an adjacent pair of said teeth.

3. A measuring device as set forth in claim 1 wherein said thread guide has a plurality of eyelets therein forming said guide surfaces.

4. A measuring device as set forth in claim 1 wherein said circumferential surface is stepped to define a plurality of cylindrical sections with interconnecting conical surfaces therebetween.

5. A measuring device as set forth in claim 1 wherein said plane is disposed relative to said circumferential surface of said winding body such that the single turns of thread have essentially the same length.

6. A method of adjusting the length of a travelling thread fed to a processing station, said method comprising the steps of passing the travelling thread over a rotating conical winding body having an outer circumferential surface to form a plurality of thread windings thereon, guiding each one of a plurality of said windings over a respective guide surface of a plurality of guide surfaces spaced from said body along a plane oblique to the circumferential surface, and adjusting the guide surface relative to the winding body during rotation of the winding body at a constant speed to adjust the thread length travelling over the winding body per unit time.

7. A method as set forth in claim 6 wherein the guide surfaces are adjusted along said plane longitudinally of the winding drum surface.

8. A method as set forth in claim 6 wherein each of said winding has essentially the same length.

* * * * *

UNITED STATES PATENT AND TRADEMARK OFFICE

CERTIFICATE OF CORRECTION

PATENT NO. : 4,320,786

DATED : March 23, 1982

INVENTOR(S) : KARL POPP

It is certified that error appears in the above—identified patent and that said Letters Patent is hereby corrected as shown below:

Column 2, line 40, change "threaded" to --thread--

Column 2, line 48, after "such as" insert --a--

Column 3, line 10, after "exactly" insert --equal--

Column 3, line 15, change "windings" to --winding--

Signed and Sealed this

*Thirteenth* Day of *July 1982*

[SEAL]

*Attest:*

GERALD J. MOSSINGHOFF

*Attesting Officer*

*Commissioner of Patents and Trademarks*